United States Patent [19]

Hayden

[11] 4,193,052

[45] Mar. 11, 1980

[54] LOW CURRENT RELAY

[75] Inventor: Rodney Hayden, Stoney Creek, Canada

[73] Assignee: TRW Inc., Cleveland, Ohio

[21] Appl. No.: 888,117

[22] Filed: Mar. 20, 1978

[51] Int. Cl.[2] ..... H01H 67/02

[52] U.S. Cl. ..... 335/128; 335/202

[58] Field of Search ..... 335/124, 128, 200, 202, 335/203

[56] References Cited

U.S. PATENT DOCUMENTS

| | | | |
|---|---|---|---|
| 3,893,194 | 7/1975 | Hayden | 335/202 |
| 4,061,994 | 12/1977 | Minks | 335/202 |

*Primary Examiner*—George Harris

*Attorney, Agent, or Firm*—James R. O'Connor

[57] ABSTRACT

An electrical relay of the low current type and general purpose usage in alternating current and direct current circuitry is provided in four main components in structural combination and organization enabling manufacture and assembly by automation techniques at a high degree of accuracy, and more particularly comprising a base mounting a core, the core in turn pivotally mounting an actuator thereby supported in engagement with a spring armature anchored to the base and movable by the actuator upon pivotal actuation of the latter, the assembly of core and base being adapted accurately to locate the actuator.

6 Claims, 10 Drawing Figures

COPPER CLADDING

LOW CURRENT RELAY

BACKGROUND OF THE INVENTION

This invention relates to a production relay characterized by four main structural components consisting of a base, a spring armature mountable on said base, a core mountable on said base in a predetermined location relative thereto and said armature, and an actuator pivoted on the core and movable on energizing the core by a winding thereon to deflect the armature, the unenergized position of said actuator being determined by a stop face defined by a mounting post on said core rising from said base.

THE PRIOR ART

In producing a general purpose relay of the low voltage low current type as may be used in automobile and domestic appliance circuitry, the manufacturer is faced with a number of conflicting requirements. The magnetic gap for the relay is required to be provided at a particular dimension in order to achieve a reliable response of the relay. Generally this will require adjustment of the relay components by manual operation and leads to errors resulting in a percentage of rejects which is unduly costly. The use of separate springs very common in this class of relay to bias the actuating part for the relay armature renders such a structure substantially incapable of assembly by automatic means. There continues to be a need for a constructional organization for this general class of relay permitting automatic assembly without adjustment.

BRIEF DESCRIPTION OF THE INVENTION

The invention concerns an electrical relay adapted for production assembly by automated techniques in which four main components comprising a base structure, a spring armature mounted on the base and a core member mounted on the base relative to said armature pivotally supports an actuating member for the armature movable between the core and a stop face on the base through a predetermined air gap specifically determined by the assembly of the core to the base.

DETAILED DESCRIPTION OF THE PREFERRED EMBODIMENTS

Figures 1, 2, 3, 4, 5, 6, 7, 8, 9, 10:
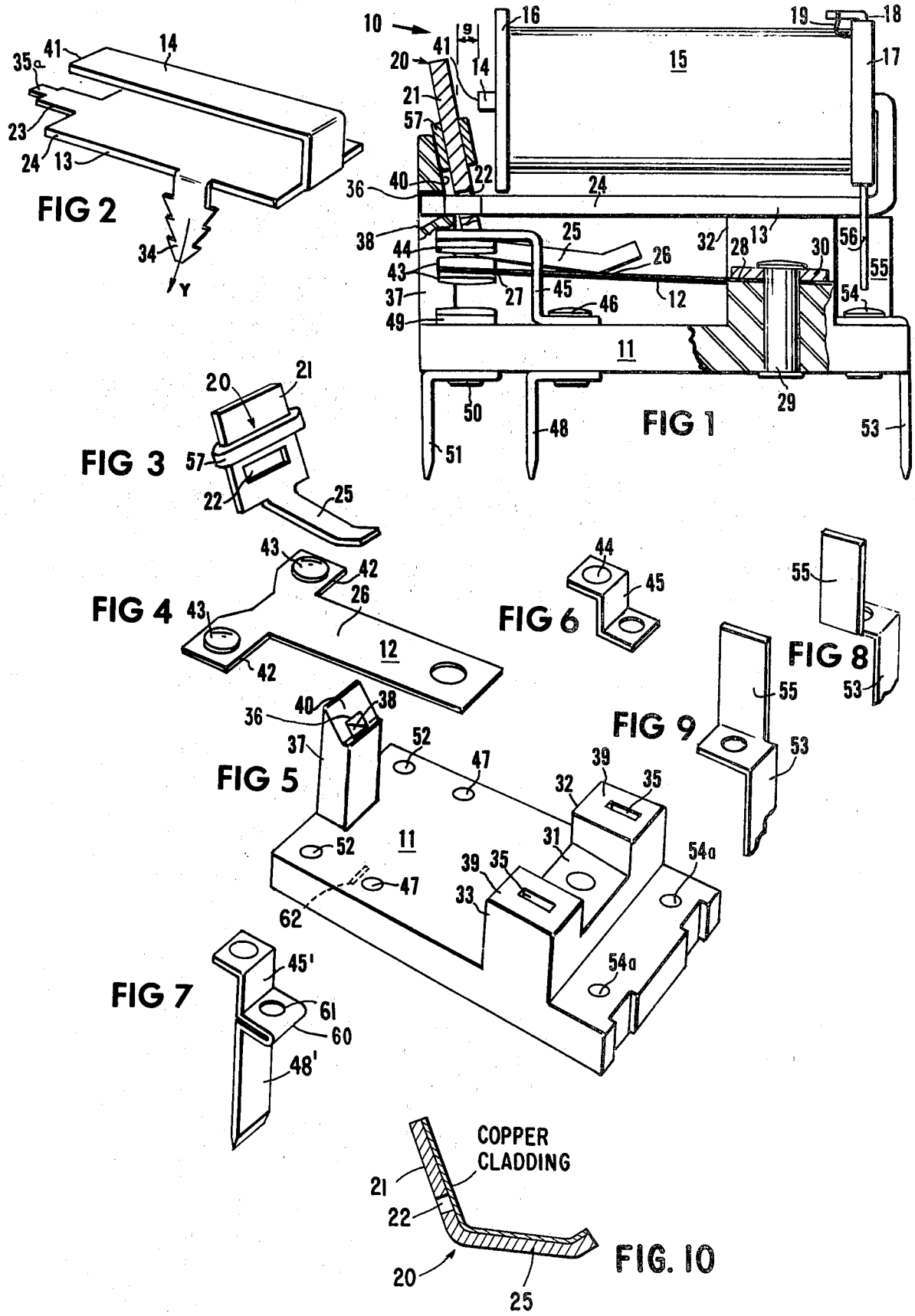
FIG. 1 is a side elevation, partly cut away, revealing the organization of components of the invention especially as to the consistent air gap feature as determined by the assembly of the components.
FIG. 2 is a perspective view of the fixed core part of the assembly of FIG. 1.
FIG. 3 is a perspective view of the movable core part actuator, i.e., the actuating lever of the assembly of FIG. 1.
FIG. 4 is a perspective view of the leaf spring armature of the assembly of FIG. 1.
FIG. 5 is a perspective view of the base with which the components of FIGS. 2, 3 and 4 are assembled.
FIGS. 6 and 7 are normally closed contact brackets of the assembly of FIG. 1.
FIGS. 8 and 9 show winding connector terminals adapted for assembly to the base of FIG. 5 and indicated in FIG. 1.
FIG. 10 is a cross-sectional view of the movable core part actuator of FIG. 3 with a layer of copper cladding in its upper surface.

The relay 10 embodies the base 11 carrying armature 12 and fixed core part 13 thereabove, the upper free leg 14 of core part 13 having a winding 15 between the winding form ends 16 and 17, the latter having extending therethrough connecton rods 18 to which winding ends 19 are joined. Movable core part actuator 20 embodies rectangular free flange part 21 containing a rectangular aperture 22 fitting pivotally about a reduced dimension pivotal section 23 of the lower arm portion 24 of core 13, said flange portion joining to an angular lever arm 25 extending for engagement in slidable fashion to upper surface 26 of armature 12 between the free end contact portion 27 thereof and the anchorage portion 28 fastened as by rivet 29 and keeper plate 30 to an anchorage portion 31 of base 11 located between spaced apart abutments 32, 33 (FIG. 5).

As indicated in FIG. 2, the lower arm portion 24 carries downwardly extending barbed fingers 34 adapted lockably to engage in recesses 35 of abutments 32, 33 to locate arm 24 firmly thereon and to present the toe section **35*a* of arm 24 within the close tolerance divergent opening or socket 36 of locating post 37 rising from base 11** and forming a part of the latter.

Thus, considering first that the free or upper leg 14 of fixed core part 13 is supplied for assembly with winding 15 and winding connections to connecting rods 18, the movable core part actuator 20 is assembled thereon and such assembly moved to engage toe **35*a* in socket 36 at an outward angle allowed by diverging surface 38 permitting fingers 34 to be rotated in conformity with their slightly arcuate design to conform to path Y about toe 35*a* to effect assembly thereof within the socket recesses 35 until arm 24 is brought into full engagement with upper surface 39 of abutments 32, 33. By reason of sloping surface 40 on locating post 37, such acting as a stop face, movable core part 20 may accomplish freedom of motion only between such face and attracting face 41 of free leg 14** thus defining a gap of a dimension "g" therebetween such being reproducible on a continuous assembly basis with stamped and molded parts.

The free end 27 of armature 12 is characterized by side arms 42 carrying upper and/or lower contact buttons 43 adapted to articulate with stationary contacts. For example the upper stationary contacts 44 on contact brackets 45 serve as normally closed contacts said brackets being fastened as by rivets 46 through holes 47 in base 11 to terminal arms 48.

Normally open contact members 49 adapted to articulate with contacts 43 extend for rivet connection at 50 to terminal legs 51 through base holes 52.

Terminal fittings 53 are fastened as by rivets 54 through holes **54*a* in the base and embody inward upstanding flange connectors 55 located to be overlapped by the downwardly extending connecting portions 56 of connecting rods 18** for suitable solder junction.

An alternative structure for the connection between contacts 44 and terminal arms 48 is illustrated in FIG. 7 where the bracket 45' is made in one piece with the terminal arm 48', the folded flange 60 being received on the upper surface of base 11 for riveting through holes 61 and 47, and the arm 48' passing through a slot 62 in base 11 (illustrated in broken lines adjacent one of the holes 47 in FIG. 5). This arrangement enables low resistance connection between respective contacts 44 and the corresponding terminal arm to be achieved, since current is not then transmitted through the rivet 46 in hole 47. Low resistance transmission between terminal legs 51 and their respective fixed contacts 49 may be accomplished by placing the flange of the leg 51 on the upper surface of the base 11 so that contact 49 is mounted directly on this flange with the leg 51 passing through a slot in base 11 similar to slot 62 or overlapping the base similarly to the legs of terminals 53 as illustrated. In some circumstances, as for instance where low currents are involved, some or all of the discrete contacts 43, 44 and 49 may be omitted to be replaced merely by contacting surfaces on the respective members concerned.

Although an arrangement has been shown with a single pole double throw, it is clear that contacts may be omitted where not required. By arranging additional vertically stacked fixed contacts, and additional vertically stacked side arms (insulated from one another) on armature 12, a double or more pole relay can be produced. Extra clearance beneath the core 13 can be provided by raising the height of post 37, anchorage portion 31 and abutments 32 and 33.

Having regard to the class of relay herein considered, it has been found permissible even for applications of substantial duty cycle to use a shading coil 57, being a continuous band of copper or other high conductivity material, transversely about the section of the movable core part 20 and preferably adjacent the attracting face 41 of free leg 14 of fixed core part 13 and between said face and the lower arm portion 24 thereof. By this means the production relay of the invention is made suitable in a practical sense for a large variety of alternating current applications.

Where the relay is employed for DC and quick release is required, it may be desirable to include a layer of non-magnetic material on the face of flange part 21 which contacts attracting face 41 of core 13. The low magnetic reluctance of the closed circuit effected by core 13 and actuator 20 is thus increased by the presence of this material which conveniently may be introduced by stamping the actuator 20 from a copper clad steel sheet, clad on the side which will contact face 41.

I claim:

1. A relay capable of accurate assembly by automation techniques and comprising: an insulate base having laterally spaced apart abutment members rising therefrom to define therebetween an anchorage surface and equidistant and remotely therefrom a location post rising from said base and containing a core locating socket; a spring armature extending from said anchorage surface towards said post and presenting contact arm portions thereon; a magnetic flux conducting fixed core part in the form of a lower leg and an upper winding leg substantially parallel thereto said lower leg having a toe portion seatable in the socket of the locating post; means anchoring said lower core arm to said abutment of said base; a movable core part actuator pivoted on said lower arm and having a lever arm portion extending for engagement with said spring armature; and a free flange on said actuator located near an attracting face of a free end of said winding arm portion at a predetermined distance therefrom.

2. A relay according to claim 1 including a stop face portion on the locating post of said base and engageable by said actuator to determine the position of the latter at said predetermined distance.

3. A relay according to claim 1 in which the core locating socket of the locating post is in the form of a divergent outward opening accommodating the assembly of the toe portion of the lower leg of the core at an outward angle relative to said base; and the core includes barbed finger members forming a part of said lower leg and serving as the means for anchoring the lower core arm to the abutments of said base.

4. A relay according to claim 1 including a shading coil on said movable core part actuator between the winding leg and the lower leg of said fixed core part.

5. A relay according to claim 1 wherein said free flange on said movable core part actuator has a layer of nonmagnetic material disposed thereon.

6. A relay according to claim 5 wherein said nonmagnetic material is copper.

* * * * *